United States Patent [19]

Kageyama et al.

[11] 4,413,207

[45] Nov. 1, 1983

[54] MULTICAVITY KLYSTRON

[75] Inventors: Takao Kageyama; Yoshiaki Suzuki; Eiichi Watanabe, all of Tokyo, Japan

[73] Assignee: Nippon Electric Co., Ltd., Tokyo, Japan

[21] Appl. No.: 210,817

[22] Filed: Nov. 26, 1980

[30] Foreign Application Priority Data

Dec. 5, 1979 [JP] Japan ..... 54-157676
Dec. 5, 1979 [JP] Japan ..... 54-157677

[51] Int. Cl.[3] ..... H01J 23/20

[52] U.S. Cl. ..... 315/5.52; 315/5.39; 315/5.38; 315/5.51

[58] Field of Search ..... 315/5.39, 5.38, 5.51, 315/5.52

[56] References Cited

U.S. PATENT DOCUMENTS

| | | | |
|---|---|---|---|
| 3,179,839 | 4/1965 | Schmidt | 315/5.38 |
| 3,297,907 | 1/1967 | LaRue et al. | 315/5.38 |
| 3,368,104 | 2/1968 | McCullough | 315/5.38 |
| 3,450,930 | 6/1969 | Lien | 315/5.38 X |
| 3,644,778 | 2/1972 | Mihran et al. | 315/5.38 |
| 3,700,963 | 10/1972 | Shimada | 315/5.38 |
| 3,936,695 | 2/1976 | Schmidt | 315/5.38 |
| 3,940,655 | 2/1976 | Palluel et al. | 315/5.37 |
| 4,207,494 | 6/1980 | Hatakenaka et al. | 315/5.38 |

OTHER PUBLICATIONS

IEEE Transactions on Electron Devices, vol. ED-24, No. 1, Jan. 1977, pp. 3-12 by Takao Kagryama, Yoshihiro Morizumi, Eiichi Watanabe.

*Primary Examiner*—Saxfield Chatmon
*Attorney, Agent, or Firm*—Blakely, Sokoloff, Taylor & Zafman

[57] ABSTRACT

A multicavity klystron includes a plurality of drift tubes for passage therethrough of a beam of electrons from an electron gun toward an electron collector via a plurality of cavity resonators arranged successively between the electron gun and the collector. One of the drift tubes which is located next to the collector has an inside diameter which is smaller than that of the other drift tubes.

6 Claims, 3 Drawing Figures

MULTICAVITY KLYSTRON

BACKGROUND OF THE INVENTION

The present invention relates to a multicavity klystron.

Klystrons of the type described have been improved in efficiency from 30%–40% to about 50%. Efforts to increase the efficiency up to 60%, however, often have met with unstable operational conditions such as ringing on heavy pulse signals and oscillation. A source of such unstable operational phenomena has been considered to be secondary electrons back-streaming in a direction reverse to that of the primary electrons emitted from the electron gun toward the collector.

As a prior attempt to reduce such back-streaming secondary electrons, U.S. Pat. No. 3,940,655 discloses that the central axis in the high-frequency circuit region is displaced from the central axis in the collector region, thereby causing the high-energy secondary electrons which travel at substantially the same speed as that of the primary electrons, to make asymmetrical collision so that the number of secondary electrons back-streaming into the high-frequency circuit region can be reduced. According to U.S. Pat. No. 3,936,695, a plurality of conductive baffle members extend inwardly from the internal surface of the collector to limit the path in which the high-energy secondary electrons can travel back into the high-frequency circuit region.

The prior art proposals have been based on the assumption that the back-streaming electrons are constituted by secondary electrons generated by bombardment of the primary beam of electrons upon a surface in the collector region. According to the afore-mentioned U.S. patents, however, the tubes are complicated in structure, and no effective means can be provided for eliminating unstable operational phenomena in high-efficiency klystrons.

SUMMARY OF THE INVENTION

It is an object of the present invention to provide a high-efficiency multicavity klystron having a relatively simple structure which controls back-streaming electrons and removes deteriorations in characteristics.

According to the present invention, a drift tube which is located next to an electron collector for passage of a beam of electrons has an inside diameter which is smaller than that of remaining drift tubes. The drift tube next to the collector has a wall thickness which becomes progressively larger toward the collector. Alternatively, the drift tube next to the collector may have an enlarged bore into which a tube extends from the collector, with the inside diameter of the tube from the collector being the same as the diameter of the opening of the drift tube which faces toward an adjacent gap in an output cavity resonator.

The above and other objects, features and advantages of the present invention will become apparent from the following description when taken in conjunction with the accompanying drawings which show preferred embodiments of the invention by way of illustrative example.

DESCRIPTION OF THE PREFERRED EMBODIMENTS

Figure 1:
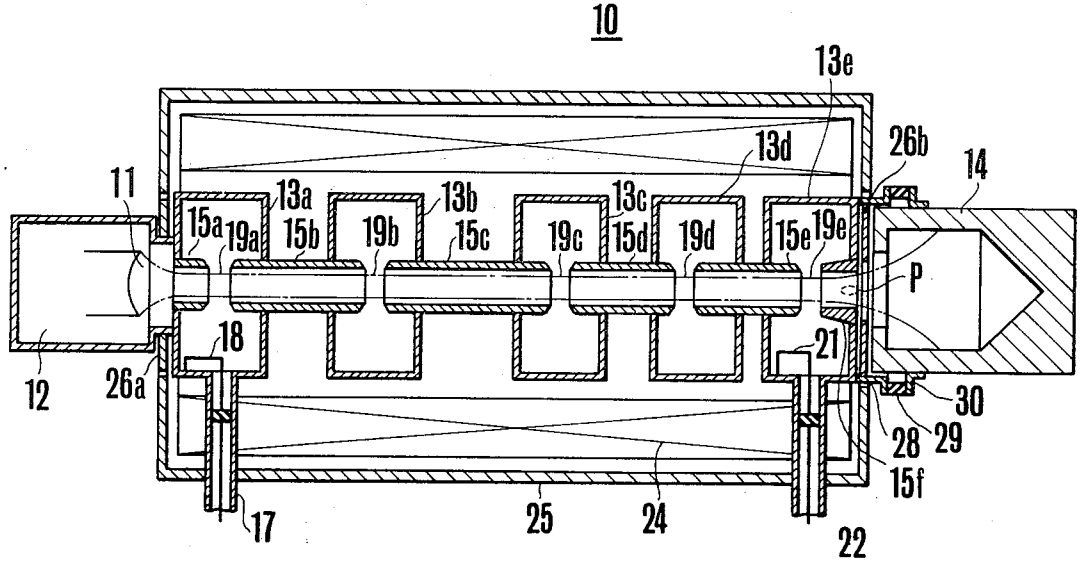
FIG. 1 is a vertical cross-sectional view of a multicavity klystron according to an embodiment of the present invention.

According to the conventional analysis of the problems as described above, it has been considered that the unstable operational phenomena which high-efficiency multicavity klystrons suffer from are caused by secondary electrons emitted from the collector into the klystron tube in a direction reverse to that of the primary beam of electrons. Based on detailed experiments and computerized analysis with respect to high-efficiency klystrons, however, the present inventor has found that the back-streaming electrons are generated due primarily to the fact that the primary beam of electrons from which kinetic energy has been extracted at the output gap becomes slow in speed and is reversed in direction of travel at a negative potential "valley" due to space charges before the electrons reach the collector.

More specifically, the primary beam of electrons which has been emitted from an electron gun passes through a plurality of cavity resonators and drift tube tunnels disposed across opposed walls of the resonators toward the electron collector. The electron beam when passing through the drift tube tunnels is converged to the extent that it has a diameter of two-thirds the inside diameter of the drift tubes under the influence of an axial magnetic field produced by a solenoid surrounding the drift tubes. Since the axial magnetic field is lessened in intensity at the collector region, the electron beam radially diverges upon entering the collector region due to its space charge forces. The electron beam also tends to radially diverge in the drift tube between the collector and the output resonator closest to the collector, from which the axial magnetic field becomes reduced progressively in the downstream direction. Accordingly, the drift tube next to the collector has a bore or tunnel expanding or diverging toward the collector. Upon going into the collector region, a substantial number of primary electrons are caused to travel at a lower speed. The foregoing analysis has been described in "A Large-Signal Analysis of Broad-Band Klystrons with Design Applications" in "IEEE TRANSACTIONS ON ELECTRON DEVICES", Vol. ED-24, No. 1, pages 3–12, published in January 1977.

The beam of electrons which has entered the collector region is still radially constricted in diameter within two-thirds the inside diameter of the drift tubes under the axial magnetic field, with the result that the space charge forces at that point are increased. With the diameter of the drift tube next to the collector becoming progressively enlarged downstream from a position where the electron beam is still constricted in diameter, there is developed a negative potential "valley" within the drift tube because of electron space charges. Such a negative potential "valley" has a potential intensive enough to force the substantial number of electrons out of the electron beam to be reversed in direction of travel after kinetic energy has been extracted from the electron beam at the output gap with the speed of travel of the electrons being reduced. The electrons thus reversed in the drift tube go back to the input resonator closest to the electron gun, thereby forming a feedback loop which gives rise to unstable operational conditions such as oscillation and ringing.

As shown in FIG. 1, a multicavity klystron 10 comprises an electron gun 12 for emitting a beam of electrons 11, a plurality, five in the illustrated embodiment, of cavity resonators 13*a*–13*e* successively arranged coaxially along the beam path, a collector 14 receptive of the electron beam passing through the resonators 13*a*–13*e*, and a plurality of coaxial drift tubes 15*a*–15*f* extending between adjacent ones of the electron gun 12, resonators 13*a*–13*e*, and collector 14 to provide communication therebetween. The resonator 13*a* serves as an input resonator for being supplied with an input signal to be amplified via an input coaxial line 17 and an input coupling loop assembly 18. The drift tube 15*a* extends from the interface between the resonator 13*a* and the electron gun 12 downstream toward the collector 14. The drift tube 15*b* has one or upstream end projecting into the resonator 13*a* and confronting the downstream end of the drift tube 15*a* with an electronic interaction gap 19*a* therebetween. The other or downstream end of the drift tube 15*b* extends into the resonator 13*b* where the drift tube 15*b* is disposed in confronting relation to the upstream end of the drift tube 15*c* with an electronic interaction gap 19*b* therebetween. Likewise, the mutually opposed ends of the drift tubes 15*c*, 15*d*, 15*e*, 15*f* project into the resonators 13*c*, 13*d*, 13*e* and define electronic interaction gaps 19*c*, 19*d*, 19*e* respectively therein.

The resonator 13*e* serves as an output resonator for producing an amplified output signal which is fed to a suitable load such as an transmitting antenna, not shown via an output coupling loop 21 and output coaxial line 22. The resonators 13*b*–13*d* serve as intermediate driver resonators.

A solenoid 24 is disposed in surrounding relation to the resonators 13*a*–13*e* to produce an axial magnetic field which acts on the electron beam 11. The solenoid 24 is covered by a cylindrical yoke 25. A pair of annular pole pieces 26*a*, 26*b* are located respectively on the sides of the input and output resonators 13*a*, 13*e* facing toward the electron gun 12 and the collector 14, respectively. The pole piece 26*b* has a central opening of such a diameter which is substantially the same as the inside diameter of the drift tube 15*f* to keep the electron beam 11 converged at the exit end of the drift tube 15*f* under the influence of the magnetic field. The output resonator 13*e*, the pole piece 26*b*, and the collector 14 are interconnected by connector members 28, 29, 30, the member 29 being made of an insulating material such as ceramics.

The foregoing structure of the klystron 10 is known in the art. Operation is as follows: When an input signal is fed to the input cavity 13*a*, a high-frequency electric field is developed across the input gap 19*a*. The electric field in the gap 19*a* velocity-modulates the beam 11. In the drift tube 15*b* located downstream of the input cavity 13*a*, the velocity modulation is converted into current density modulation which excites resonance of the next three cavities 13*b*, 13*c*, 13*d*. These three succeeding cavities act to further velocity-modulate the electron beam 11 which velocity modulation is converted in the drift tubes 15*c*, 15*d*, 15*e* into accumulated current density modulation of the beam 11 as the electrons move toward the collector 14.

In the gap 19*e* in the output cavity resonator 13*e*, the electron beam 11 which is highly density-modulated has its kinetic energy extracted and converted into electric energy as amplified output signal, which is then fed via the output coupling loop 21 and the output coaxial line 22 to the load such as a transmitting antenna. The electron beam 11 which goes through the drift tube 15*f* into the collector 14 includes a relatively small number of electrons which move at a high speed due to accumulated current velocity modulation through the gaps 19*a*–19*e* and a substantial number of electrons which move at a low speed after they have lost kinetic energy at the gap 19*e*.

The solenoid 24 surrounds the cavities 13*a*–13*e* produce an axial magnetic field, the yoke 25, the pole pieces 26*a*, 26*b* constituting a magnetic circuit to strengthen the magnetic field on the axis of the klystron 10. The axial magnetic field thus formed acts to constrict the beam 11 into a diameter which is on the order of two-thirds the inside diameter of the drift tubes 15*a*–15*e*. Such axial magnetic field is lessened in the collector region where the beam 11 diverges radially due to its own space charge forces.

Figure 2:
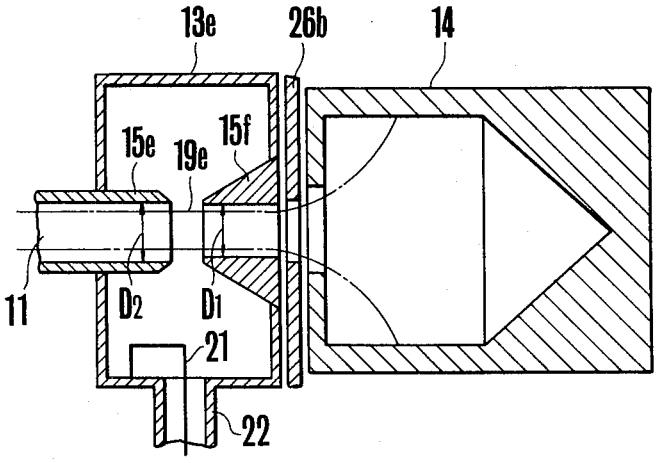
FIG. 2 is an enlarged cross-sectional view of a portion of a tube and an electron collector of the klystron shown in FIG. 1.

According to the present invention, the drift tube 15*f* mounted in the output cavity resonator 13*e* closely to the collector 14 is substantially cylindrical in shape with an inside diameter $D_1$ thereof being smaller than the inside diameter $D_2$ of the other drift tubes 15*a*–15*e*. More specifically, the inside diameters $\frac{2}{3} D_2 < D_1 < D_2$ are selected so as to satisfy the relation: $\frac{2}{3} D_2 < D_1 = D_2$. Where the inside diameter $D_1$ is smaller than $\frac{2}{3}D_2$, the electron beam 11 strikes the inner surface of the drift tube 15*f*. As a result, the drift tube 15*f* is heated and expanded, causing the resonance frequency of the cavity 13*e* to be varied or causing gas to be emitted. Where the inside diameter $D_1$ is larger than the inside diameter $D_2$, the prior art difficulties will be experienced. With the arrangement shown in FIG. 2, the drift tube 15*f* has a thickness larger than that of the drift tubes 15*a*–15*e* to improve thermal capacity and conductivity. The drift tube 15*f* is made of copper or molybdenum having relatively high thermal conductivity. It is required that capacitance in the gap 19*e* between the opposed ends of the drift tubes 15*e*, 15*f* be as small as possible. To this end, the drift tube 15*f* is structured such that its wall thickness becomes progressively larger toward the collector 14. Such a structure eliminates the negative potential "valley" which would otherwise be developed at P(FIG. 1) in the drift tube 15*f* due to the space charges of the electrons. In addition, a potential in the interior of the drift tube 15*f* and the collector 14 is distributed such that it accelerates the electrons along the collector wall surface. The electron beam 11 from which kinetic energy has been extracted at the gap 19*e* is accelerated rather than decelerated. Therefore, back-streaming electrons will not be produced with a relatively simple structure which is designed to remove the negative potential "valley" from the drift tube 15*f* which would be caused to be developed with the structure disclosed in U.S. Pat. No. 3,936,695.

The drift tube 15*f* has adjacent to the collector 14 an opening which is small in diameter as compared with the opening in the prior art drift tube (corresponding to 15*f*) such as shown in U.S. Pat. No. 3,936,695. Thus, the central hole in the pole piece 26*b* is correspondingly small to maintain the axial magnetic field sufficiently intensive in the region of the drift tube 15*f*. Even if the inside diameter $D_1$ is smaller than the inside diameter $D_2$, the flow of the electron beam 11 into the drift tube 15*f* is minimized.

With the inside diameter of the drift tube 15*f* being smaller than that of the conventional arrangement, the number of electrons which are caused in the collector region to return back into the drift tubes are reduced.

Figure 3:
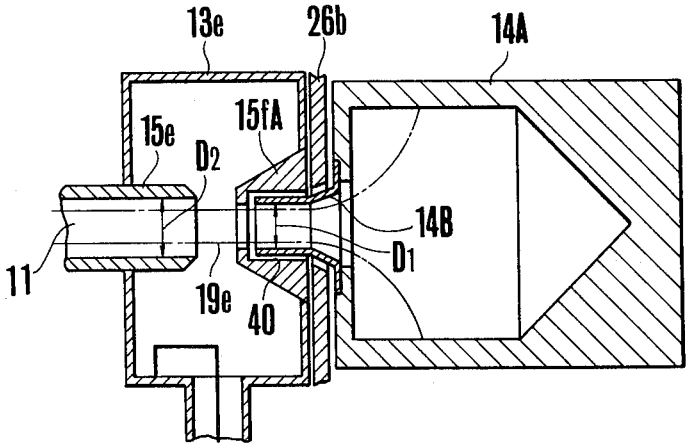
FIG. 3 is a view similar to FIG. 2, showing a modification.

According to another embodiment shown in FIG. 3, a collector 14A has a tube 14B of molybdenum extending from the opening of the collector 14A into a drift tube 15*f*A which is located in the output cavity 13*e* and next to the collector 14A. More specifically, the drift tube 15*f*A has an enlarged bore 40 extending from the opening of the drift tube 15*f*A adjacent to the collector 14A, the bore 40 having a depth so selected as to allow the output cavity 13*e* to be free from malfunctioning. The tube 14B of the collector 14A is mounted in the enlarged bore 40 in the drift tube 15*f*A. The portion of the tube 14B which is inside of the drift tube 15*f*A has an inside diameter which is the same as the constricted opening of the drift tube 15*f*A which faces toward the gap 19*e*. The remaining portion of the tube 14B which is outside of the drift tube 15*f*A flares away from the drift tube 15*f*A toward the collector 14A. The arrangement according to the embodiment of FIG. 3 functions in the same manner as and has the same advantages as the embodiment shown in FIG. 2.

Although certain preferred embodiments have been shown and described in detail, it should be understood that changes and modifications may be made therein without departing from the scope of the appended claims.

What is claimed is:

1. A multicavity klystron comprising:

(a) an electron gun for emitting a beam of electrons;

(b) an input cavity resonator disposed adjacent to said electron gun for being supplied with an input signal to be amplified;

(c) at least one intermediate driver cavity resonator disposed adjacent to said input cavity resonator;

(d) an output cavity resonator disposed adjacent to said intermediate driver resonator for producing an amplified output signal;

(e) a collector disposed adjacent to said output resonator for receiving the beam of electrons;

(f) a plurality of drift tubes for passage therethrough of the beam of electrons from said electron gun via said cavity resonators to said collector;

(g) said electron gun, said input, intermediate driver, and output cavity resonators, and said drift tubes being coaxially arranged; and (h) one of said drift tubes which is mounted in said output cavity resonator and next to said collector having an inside diameter which is smaller than that of the other drift tubes.

2. A multicavity klystron according to claim 1, said drift tube next to said collector having a wall thickness progressively larger toward said collector.

3. A multicavity klystron according to claim 1 or 2, said drift tube next to said collector being made of either one of copper and molybdenum.

4. A multicavity klystron according to claim 1 or 2, said drift tube next to said collector having an enlarged bore extending from an opening of said drift tube adjacent to said collector, including a tube extending from said collector and mounted in said enlarged bore, said last-mentioned tube having an inside diameter which is the same as that of an opening of said drift tube which is closer than said collector to said electron gun.

5. A multicavity klystron according to claim 4, said tube which extends from said collector being made of molybdenum.

6. A multicavity klystron according to claim 1, including an annular pole piece located adjacent to said output cavity resonator and having an opening of such a diameter which is substantially the same as the inside diameter of said drift tube next to said collector.

* * * * *

UNITED STATES PATENT AND TRADEMARK OFFICE

CERTIFICATE OF CORRECTION

PATENT NO. : 4,413,207

DATED : 11-1-83

INVENTOR(S) : Takao Kageyama; Yoshiaki Suzuki; Eiichi Watanabe

It is certified that error appears in the above-identified patent and that said Letters Patent is hereby corrected as shown below:

| COLUMN | LINE | DESCRIPTION |
|---|---|---|
| 4 | 26 | Delete "$\frac{2}{3}$ $D_2 < D_1 < D_2$", insert --$D_1$, $D_2$--. |
| 4 | 27 | Delete "$\frac{2}{3}$ $D_2 < D_1 = D_2$", insert --$\frac{2}{3}$ $D_2 < D_1 < D_2$--. |

Signed and Sealed this

First Day of January 1985

[SEAL]

*Attest:*

*Attesting Officer*

GERALD J. MOSSINGHOFF

*Commissioner of Patents and Trademarks*